US008550050B2

(12) United States Patent
Taniguchi et al.

(10) Patent No.: US 8,550,050 B2
(45) Date of Patent: Oct. 8, 2013

(54) CARBURETOR AND GENERAL PURPOSE ENGINE

(75) Inventors: Toru Taniguchi, Wako (JP); Seiki Osanai, Wako (JP); Koji Matsuno, Wako (JP); Naoya Kumagai, Tokyo (JP)

(73) Assignee: Honda Motor Co., Ltd., Tokyo (JP)

( * ) Notice: Subject to any disclaimer, the term of this patent is extended or adjusted under 35 U.S.C. 154(b) by 376 days.

(21) Appl. No.: 12/976,750

(22) Filed: Dec. 22, 2010

(65) Prior Publication Data

US 2011/0168122 A1 Jul. 14, 2011

(30) Foreign Application Priority Data

Jan. 12, 2010 (JP) ..... 2010-004292

(51) Int. Cl.
*F02M 17/34* (2006.01)
*F02M 19/03* (2006.01)
*F02M 19/06* (2006.01)

(52) U.S. Cl.
USPC ..... 123/185.3; 261/71

(58) Field of Classification Search
USPC ..... 123/185.3; 261/78.1, 71, 72.1; 137/625.46
See application file for complete search history.

(56) References Cited

U.S. PATENT DOCUMENTS

| | | | | |
|---|---|---|---|---|
| 3,687,124 | A * | 8/1972 | Kolorz | 123/182.1 |
| 3,738,336 | A * | 6/1973 | Holland | 123/73 R |
| 3,780,996 | A * | 12/1973 | Nutten | 261/72.1 |
| 3,825,238 | A * | 7/1974 | Nishihara et al. | 261/36.2 |
| 3,957,930 | A * | 5/1976 | Birmingham | 261/44.3 |
| 6,244,572 | B1 * | 6/2001 | Delsole | 261/38 |
| 6,729,608 | B1 * | 5/2004 | Del Sole | 261/38 |
| 7,497,419 | B2 * | 3/2009 | Sonnenkalb et al. | 261/65 |
| 2003/0062633 | A1 * | 4/2003 | Woody | 261/37 |
| 2010/0180864 | A1 * | 7/2010 | Maekawa et al. | 123/439 |
| 2011/0140290 | A1 * | 6/2011 | Kumagai et al. | 261/66 |

FOREIGN PATENT DOCUMENTS

JP 62-33961 Y2 8/1987

* cited by examiner

*Primary Examiner* — Stephen K Cronin
*Assistant Examiner* — Arnold Castro
(74) *Attorney, Agent, or Firm* — Arent Fox LLP

(57) ABSTRACT

A carburetor provided on an intake pipe is disclosed. The carburetor includes a rotary cock attached to a fuel chamber. The cock is used for opening and closing fuel channels and drain channels. The cock has a rotational axis inclined relative to the central axis of the intake pipe.

4 Claims, 10 Drawing Sheets

(KNOWN ART)

FIG.5A
(KNOWN ART)
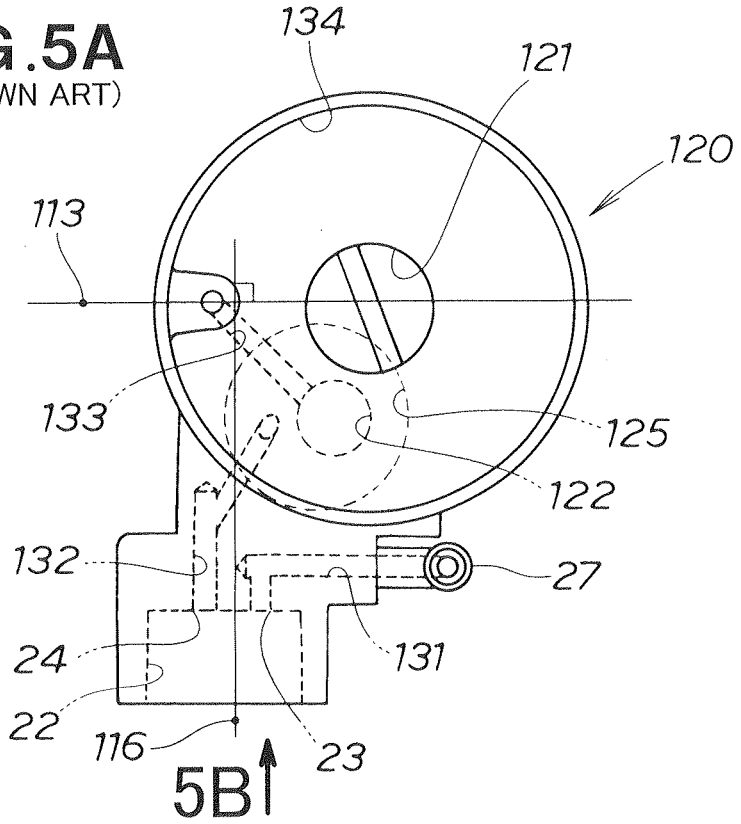
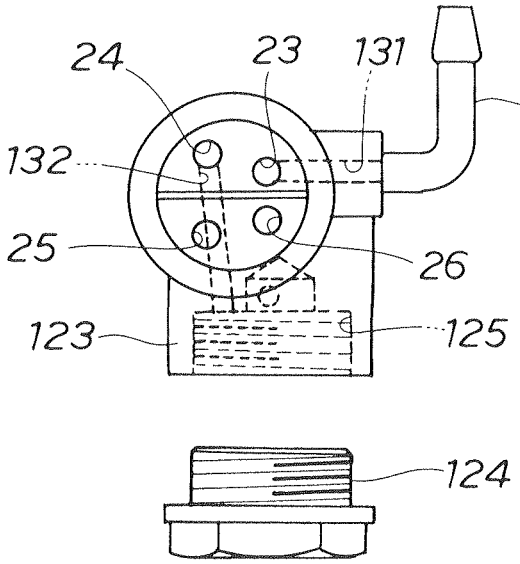
FIG.5B
(KNOWN ART)

FIG.6A
(KNOWN ART)
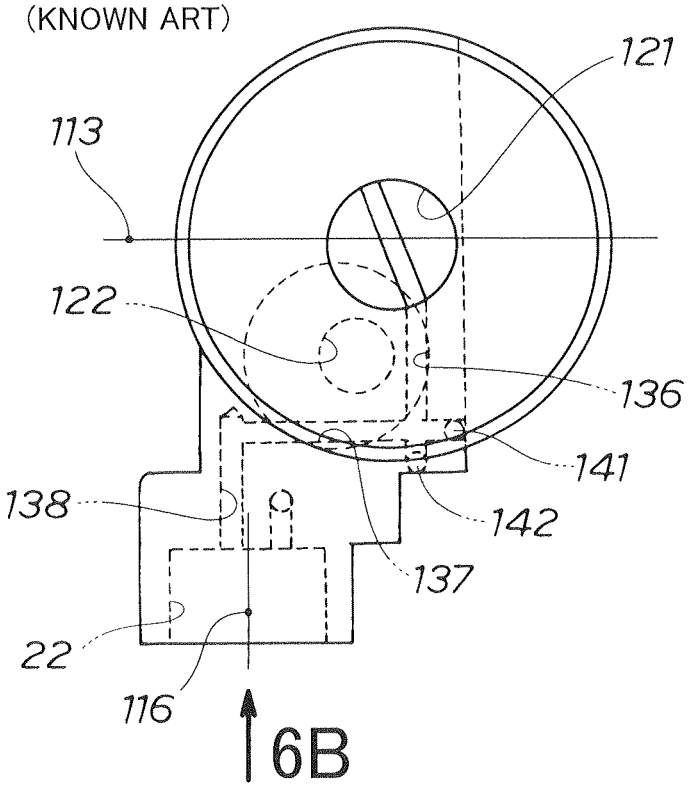
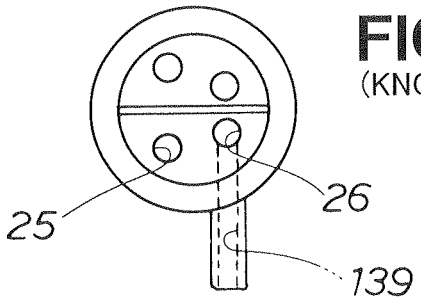
FIG.6B
(KNOWN ART)

CARBURETOR AND GENERAL PURPOSE ENGINE

FIELD OF THE INVENTION

The present invention relates to a carburetor and a general purpose engine employing the carburetor.

BACKGROUND OF THE INVENTION

General purpose engines having recoil starters, such as, for example, those disclosed in Japanese Utility Model Post-Exam Publication No. S62-33961 (JP-U 562-33961 B), are well known. FIG. 11 hereof shows the general purpose engine disclosed in JP-U S62-33961 B.

Referring to FIG. 11, a general purpose engine 100 includes a recoil starter 102 provided in front of, i.e., to the front surface of, a crankcase 101, a fuel tank 103 provided above the crankcase 101, an air cleaner 104 provided to an area to the side of the fuel tank 103, and a carburetor 105 provided underneath the air cleaner 104.

A choke lever 106 and a fuel cock lever 107 are included in the carburetor 105. To start the general purpose engine 100, the choke lever 106 and the fuel cock lever 107 are moved in an open direction. A starter grip 108 is then pulled. A crankshaft is thereupon rotated, the electrical energy necessary for ignition is supplied from the recoil starter 102, and the engine is started.

However, the recoil starter 102 and the levers 106, 107, which are operation objects, are arranged in a group on the front surface of the general purpose engine 100. This was done with considerations for the ease of operation in mind.

As a trade-off, the movement trajectory of the starter grip 108 and the levers 106, 107 come into proximity with each other. A certain degree of skill is therefore necessary for operation.

No skill will be required and operation will be facilitated if the movement trajectory of the starter grip 108 is distanced from the levers 106, 107.

A need therefore exists for a general purpose engine in which the levers and the like are sufficiently distanced from the movement trajectory of the starter grip 108, and a carburetor appropriate for this general purpose engine is required.

SUMMARY OF THE INVENTION

It is therefore an object of the present invention to provide a general purpose engine in which levers and the like are sufficiently distanced from the movement trajectory of a starter grip, and to provide an appropriate carburetor for this general purpose engine.

According to an aspect of the present invention, there is provided a carburetor having a fuel chamber and adapted to be disposed on an intake pipe such that fuel stored in the fuel chamber is siphoned and atomized by an airflow that flows through the intake pipe and mixed with the air, the carburetor comprising: a carburetor body having a pair of connectors for connecting to the intake pipe, the fuel chamber being connected to a bottom surface of the carburetor body for storing the fuel; fuel channels, provided to the fuel chamber, for guiding the fuel from a fuel tank to the fuel chamber; drain channels, provided to the fuel chamber, for guiding drains from a bottom of the fuel chamber to outside; and a rotary cock, attached to the fuel chamber, for opening and closing the fuel channels and the drain channels, wherein the cock has a rotational axis inclined relative to a central axis of the intake pipe.

The rotary cock in the present invention is thus disposed in a position below the carburetor body. In cases in which the general purpose engine is equipped with a cock, the cock can therefore be disposed below the movement trajectory of the starter grip, and can be sufficiently distanced from the movement trajectory of the starter grip.

In addition, the rotational axis of the cock is inclined in relation to the central axis of the intake pipe. In the general purpose engine, the intake pipe is disposed at an incline in relation to the crankshaft in order to satisfy the compactness requirement. The incline of the central axis of the cock and the incline of the intake pipe balance each other out, and the central axis of the cock can thereby be made parallel to the crankshaft. The cock can therefore be readily operated from one end of the crankshaft.

Preferably, the drain channels extend in a straight line from the fuel chamber to the cock. The drain channels are channels through which the remaining fuel is discharged from the fuel chamber. The remaining fuel is discharged by the action of gravity. The remaining fuel can be allowed to flow smoothly by fashioning the drain channels as rectilinear channels, making it possible to reduce the drain operation time.

According to another aspect of the present invention, there is provided a general purpose engine comprising: a crankcase; a crankshaft accommodated in the crankcase; a recoil starter provided to one end of the crankshaft for use at start-up; a connecting rod extending at a right angle from the crankshaft; a piston linked to the connecting rod; a cylinder extending from the crankcase and accommodating the piston; a cylinder head for covering one end of the cylinder; an intake pipe extending from the cylinder head; and a fuel tank, wherein the intake pipe extends obliquely toward one end of the crankshaft at a given angle of inclination relative to the crankshaft, and the carburetor is provided to the intake pipe, and wherein the carburetor comprises: a carburetor body having a pair of connectors for connecting to the intake pipe; a fuel chamber, connected to a bottom surface of the carburetor body, for storing fuel; fuel channels, provided to the fuel chamber, for guiding the fuel from a fuel tank to the fuel chamber; drain channels, provided to the fuel chamber, for guiding drains from a bottom of the fuel chamber to outside; and a rotary cock, attached to the fuel chamber, for opening and closing the fuel channels and the drain channels, and wherein the cock has a rotational axis inclined relative to a central axis of the intake pipe and extending toward one end of the crankshaft so as to be parallel with the crankshaft.

In this inventive arrangement, the rotary cock is disposed below the carburetor body. The cock in the general purpose engine can therefore be disposed below the movement trajectory of the starter grip, and can be sufficiently distanced from the movement trajectory of the starter grip.

In addition, the rotational axis of the cock is inclined in relation to the central axis of the intake pipe. In the general purpose engine, the intake pipe is disposed at an incline in relation to the crankshaft in order to satisfy the compactness requirement. The incline of the rotational axis of the cock and the incline of the intake pipe balance each other out, and the rotational axis of the cock can thereby be made parallel to the crankshaft. The cock can therefore be readily operated from one end of the crankshaft.

BRIEF DESCRIPTION OF THE DRAWINGS

Certain preferred embodiments of the present invention will be described in detail below, by way of example only, with reference to the accompanying drawings, in which:

FIG. 2A is a bottom view showing a known example carburetor arrangement in which the central axis of a cock is orthogonal to the central axis of an intake pipe, while

FIG. 5A is a view showing a fuel channel in the example carburetor arrangement of FIG. 2A, while FIG. 5B is a view as seen in the direction of arrow 5B of FIG. 5A;

FIG. 6A is a view showing a drain channel in the example carburetor arrangement of FIG. 5A, while FIG. 6B is a view seen in the direction of arrow 6B of FIG. 6A;

DETAILED DESCRIPTION OF THE PREFERRED EMBODIMENTS

Figure 1:
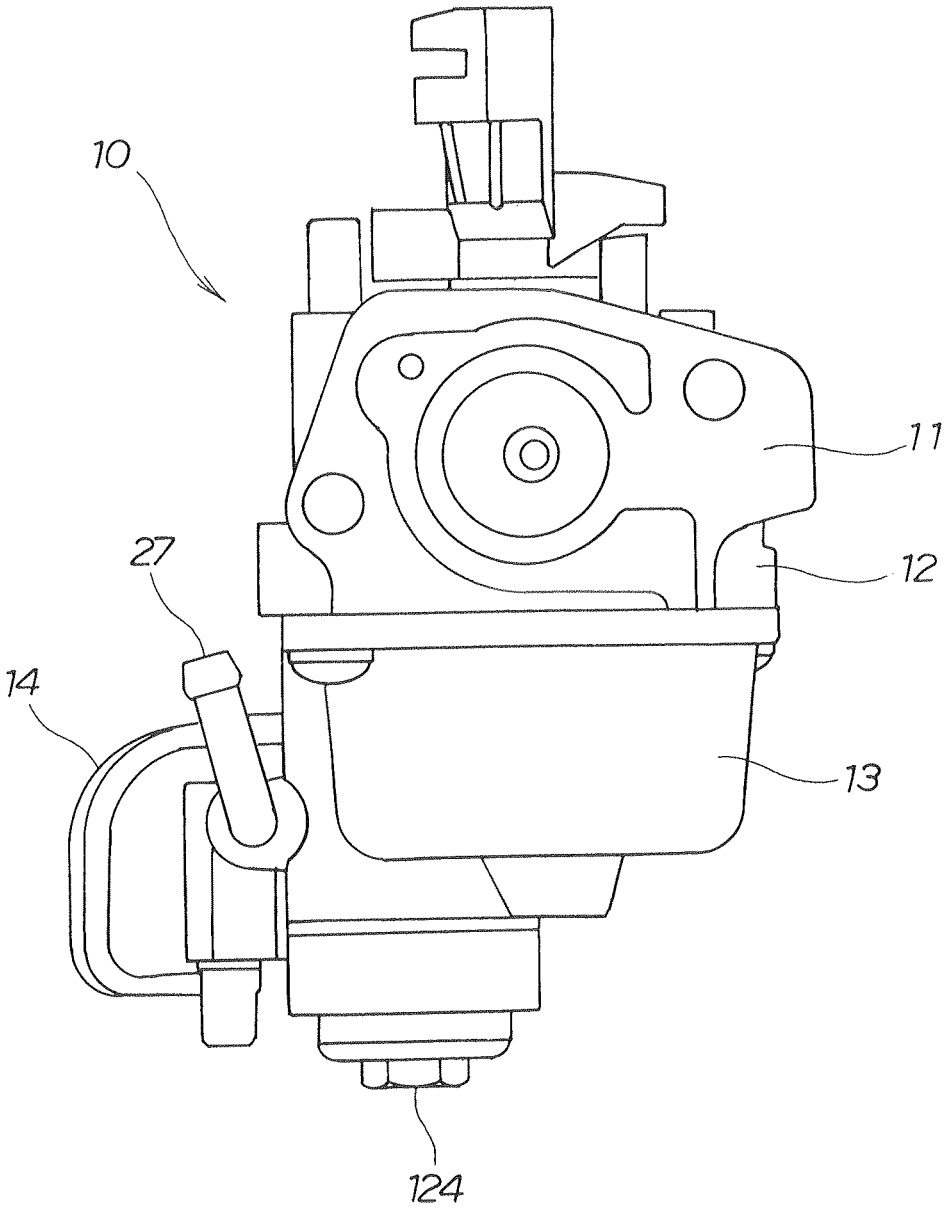
FIG. 1 is a side elevational view showing a carburetor according to an embodiment of the present invention.

Referring to FIG. 1, a carburetor 10 according to the present embodiment has a carburetor body 12 connected to an intake pipe via a connector 11, a cup-shaped fuel chamber 13 connected to a bottom surface of the carburetor body 12 and used for storing fuel, and a rotary cock 14 attached to the fuel chamber 13 and used for opening and closing a fuel channel and a drain channel.

Figure 2A:
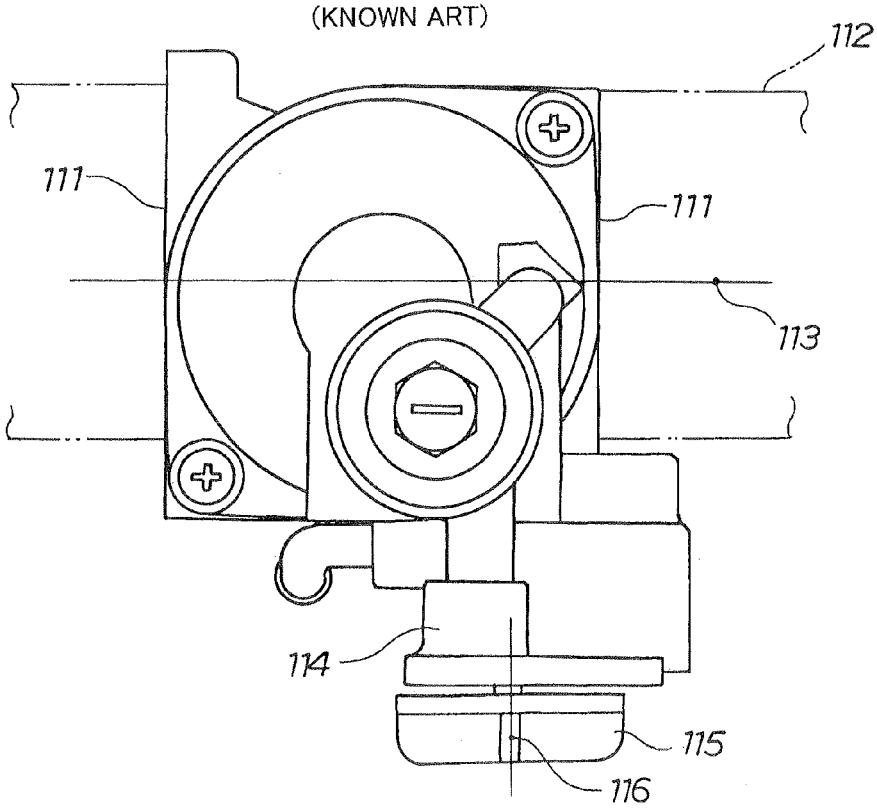

FIG. 2A shows a comparative example in which the cock axis is orthogonal to the intake pipe axis. A pair of connectors 111, 111 is connected to an intake pipe 112. The central axis 113 of the intake pipe passes through the connectors 111, 111. A cock 114 and an operating lever 115 are preferably positioned far from the intake pipe 112, making it difficult for the operator's hand to contact the intake pipe 112. Specifically, the axis 116 of the cock 114 is orthogonal to the central axis 113 of the intake pipe 112.

Figure 2B:
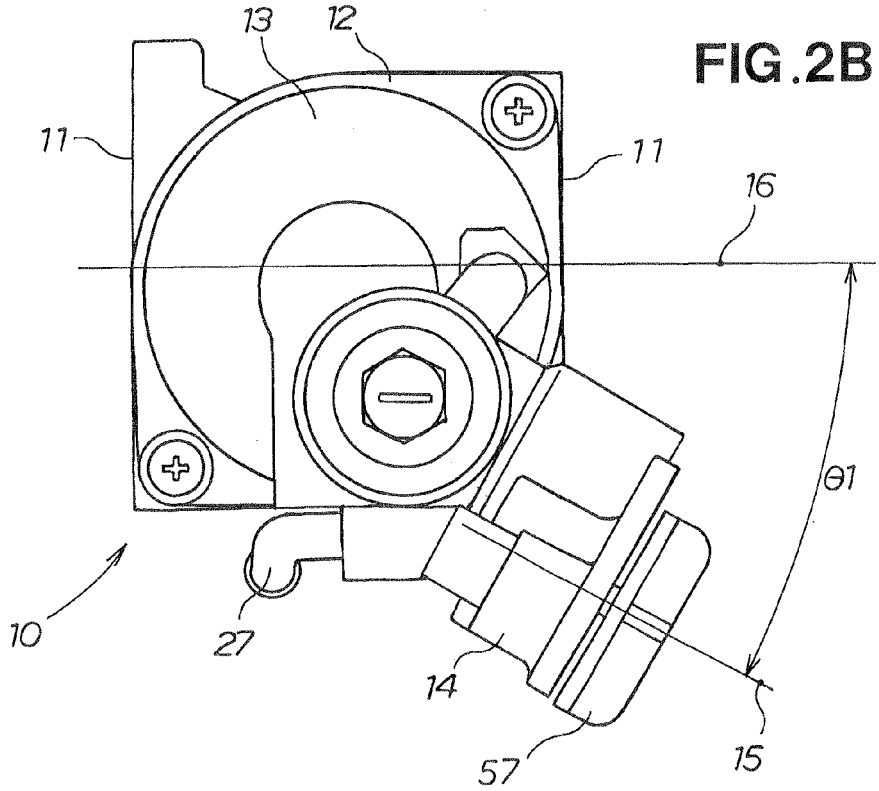
FIG. 2B is a bottom view showing a carburetor according to an embodiment of the present invention, in which the central axis of a cock is positioned at an incline to the central axis of an intake pipe.

In contrast, in the carburetor 10 of the present embodiment shown in FIG. 2B, the rotational axis 15 of the cock is inclined at an angle of inclination θ1 in relation to the central axis 16 of the intake pipe. The angle of inclination θ1 is selected from a range of 30° to 60°.

The structure of the carburetor body 12 shown in FIG. 1 is widely known, and a description of the structure will therefore be omitted hereinbelow. In contrast, the fuel chamber 13 will be described in detail because of special characteristics related to the structure of the fuel chamber 13.

Figure 3:
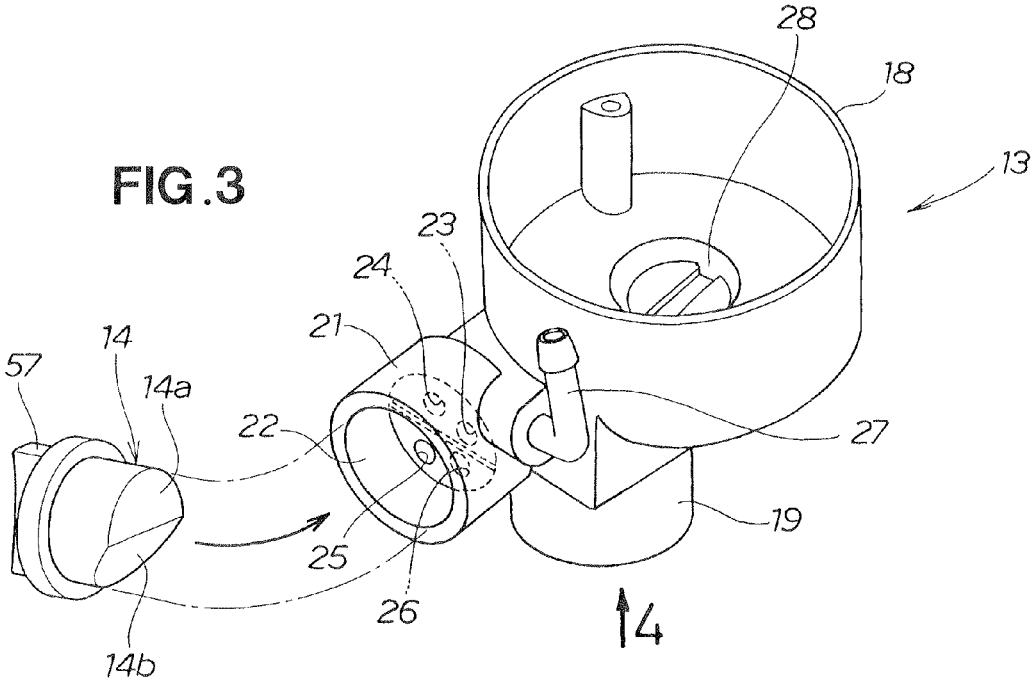
FIG. 3 is a perspective view showing a fuel chamber and a cock.

The fuel chamber 13 is a casting having a cylindrical chamber part 18 for storing fuel, a junction chamber boss 19 downwardly extending from the chamber part 18, and a cock housing part 21 horizontally extending from the chamber part 18, as shown in FIG. 3.

A cock-accommodating concavity 22 is provided to the cock housing part 21, and four holes 23, 24, 25, 26 are provided to the bottom of the cock-accommodating concavity 22. An L-shaped pipe 27 is also attached to the base of the cock housing part 21 by pounding or screwing. A circular concavity 28 is also provided to the center of the bottom surface of the chamber part 18.

Figure 4:
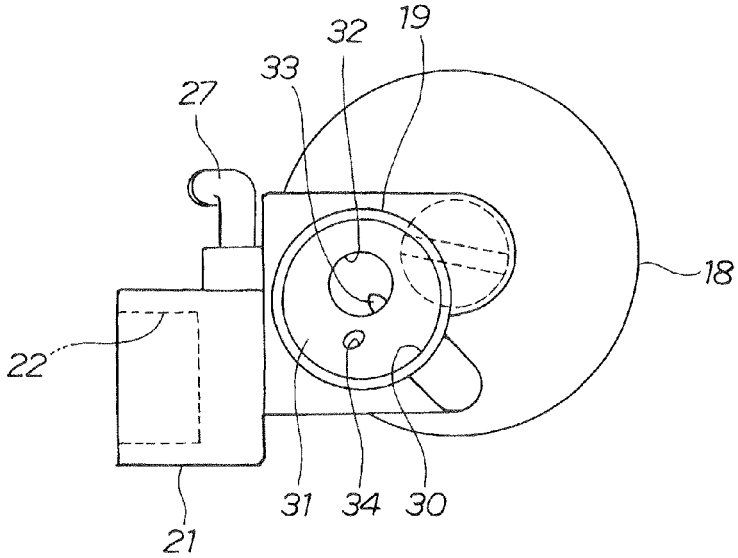
FIG. 4 is a view as seen in the direction of arrow 4 of FIG. 3.

A junction chamber 30 is provided to the junction chamber boss 19, a small-diameter concavity 32 indented on the top is provided to the ceiling 31 of the junction chamber 30, and a single hole 33 is provided to the small-diameter concavity 32, as shown in FIG. 4. A separate hole 34 is provided to the ceiling 31.

The structure of the fuel chamber in the example shown in FIG. 2A will now be described in reference to FIGS. 5A and 5B, as well as FIGS. 6A and 6B. Specifically, FIGS. 5A and 5B show a fuel channel, and FIGS. 6A and 6B show a drain channel.

A circular concavity 121 can be seen when viewing a fuel chamber 120 from above, as shown in FIG. 5A. As shown by the dashed line, a small-diameter concavity 122 is provided in a position that does not interfere with the circular concavity 121. The rotational axis 116 of the cock is orthogonal to the central axis 113 of the intake pipe 112 (FIG. 2A).

A junction chamber 125 is completed by screwing a plug bolt 124 into a junction chamber boss 123, as shown in FIG. 5B. The L-shaped pipe 27 and the hole 23 are linked by a first fuel channel 131. In addition, the hole 24 and the junction chamber 125 are linked by a second fuel channel 132.

The cock 14 has a semicircular axially orthogonal surface 14*a* and a semicircular inclined surface 14*b* on an apical surface, as shown in FIG. 3. The holes 23, 24 are blocked when the axially orthogonal surface covers the holes 23, 24. The holes 23, 24 are in communication with each other when the inclined surface covers the holes 23, 24. The same is true for the holes 25, 26.

Fuel supplied from a fuel tank reaches the cock-accommodating concavity 22 via the L-shaped pipe 27 and the first fuel channel 131 in FIG. 5A. When the holes 23, 24 are connected, the fuel reaches the junction chamber 125 via the second fuel channel 132. Moreover, the fuel reaches the inside of a chamber 134 via a third fuel channel 133 that extends from the small-diameter concavity 122 in the junction chamber 125.

Foreign matter (metallic powder, debris, air) contained in the fuel can be removed when the plug bolt 124 shown in FIG. 5B is opened.

However, draining the fuel from the chamber 134 is recommended in cases such as those in which the engine will be stopped for a long time. This is because fuel degradation and clogging of minute parts of the carburetor can be prevented during a stoppage. Draining the fuel is called "drain discharge." This procedure is described in FIGS. 6A and 6B.

The small-diameter concavity 122 is provided to an area to the side of the circular concavity 121, as shown in FIG. 6A. The drain channel therefore has a first drain channel 136 extending from the circular concavity 121 parallel to the axis 116 of the cock, a second drain channel 137 extending from the first drain channel 136 parallel to the central axis 113 of the intake pipe, and a third drain channel 138 extending from the second drain channel 137 to the cock-accommodating concavity 22 parallel to the axis 116 of the cock.

The remaining fuel passing through the first, second, and third drain channels 136 to 138 is drained through a fourth drain channel 139 extending from the hole 26 when the holes 25, 26 shown in FIG. 6B are connected. A container is placed underneath the fourth drain channel 139 to allow the remaining fuel to be recovered.

The drain channels 136 to 138 are provided in a crank shape, as shown in FIG. 6A. This is because the small-diameter concavity 122 must be circumvented. The remaining fuel is discharged by the action of gravity, and the time required for discharge is therefore increased when there is channel resistance in the drain channels 136 to 138. The man-hours required for processing are also increased because the drain channels 136 to 138 are formed by being cut with a cutting tool (piercer, drill) and provided with ball bearings 141, 142. A countermeasure for this is described in FIGS. 7A to 7C, as well as FIGS. 8A to 8C.

Figure 7A:
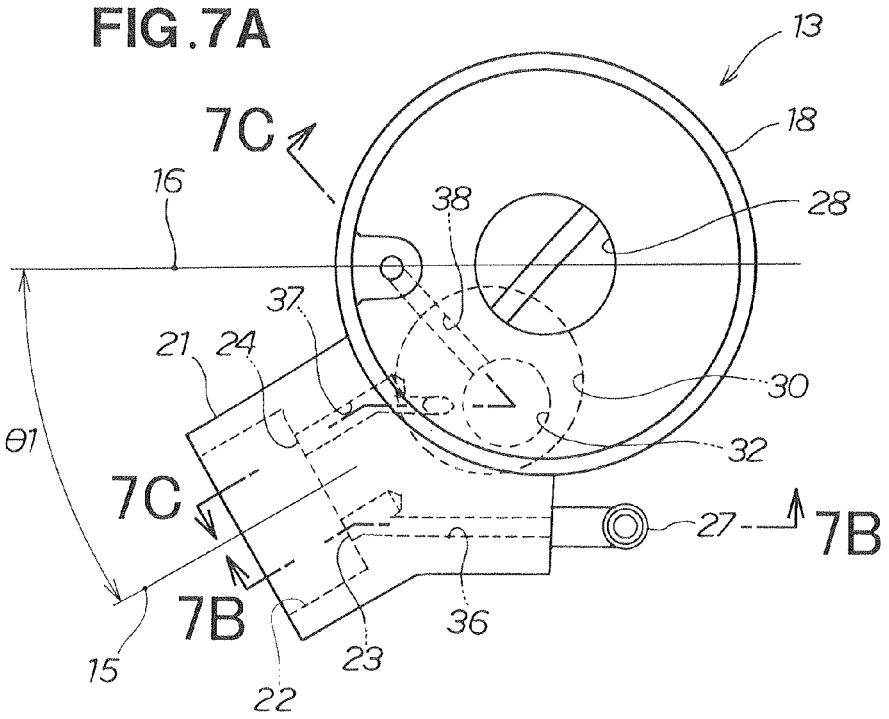
FIGS. 7A to 7C are views showing a fuel channel according to the embodiment of the present invention, FIG. 7B being a cross-sectional view taken along line 7B-7B of FIG. 7A while FIG. 7C being a cross-sectional view taken along line 7C-7C of FIG. 7A.
Figure 7B:
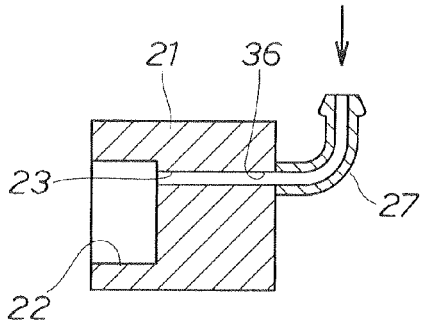
Figure 7C:
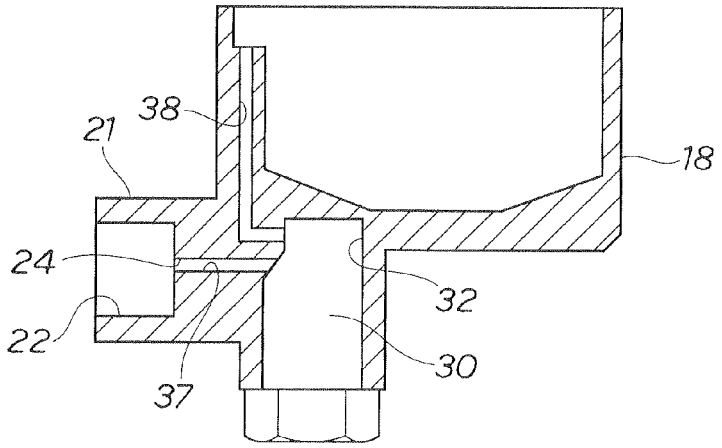
Figure 8A:
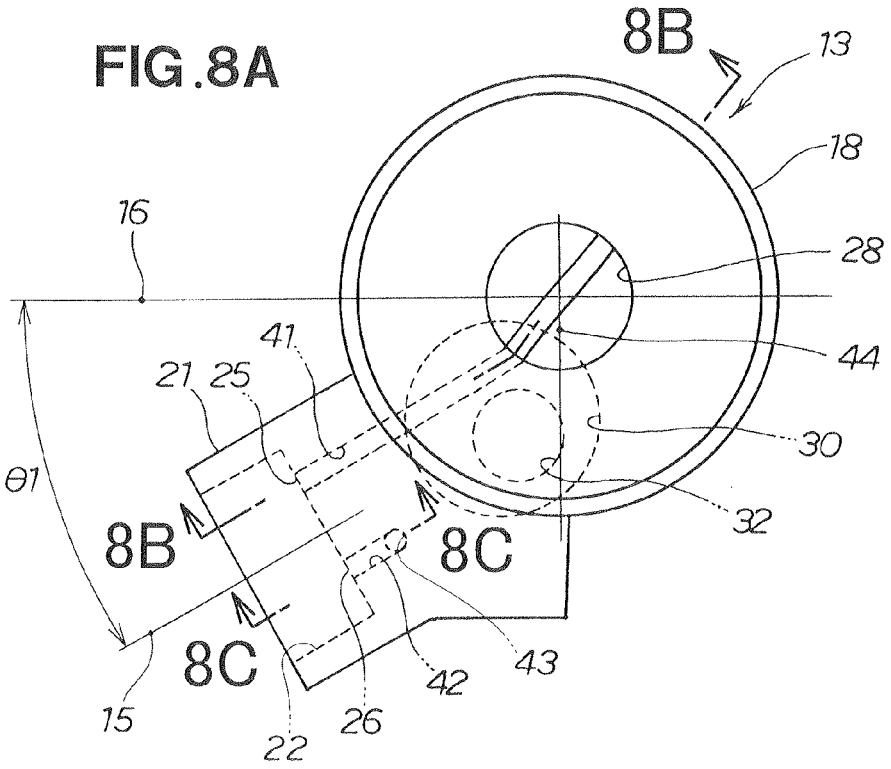
FIGS. 8A to 8C are views showing a drain channel according to the embodiment of the present invention, FIG. 8B being a cross-sectional view taken along line 8B-8B of FIG. 8A while FIG. 8C being a cross-sectional view taken along line 8C-8C of FIG. 8A.
Figure 8B:
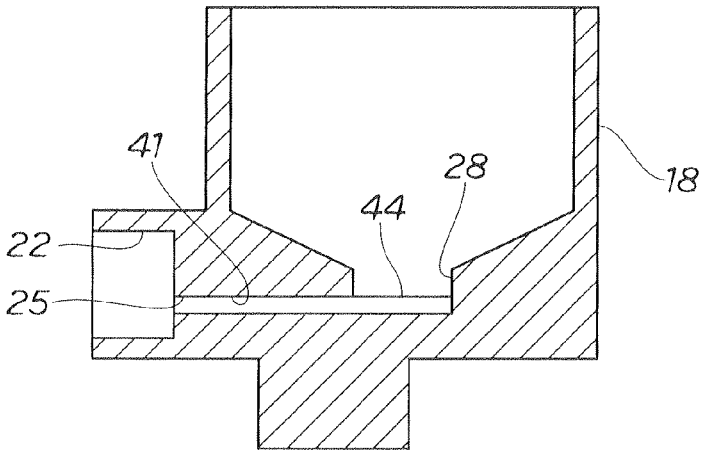
Figure 8C:
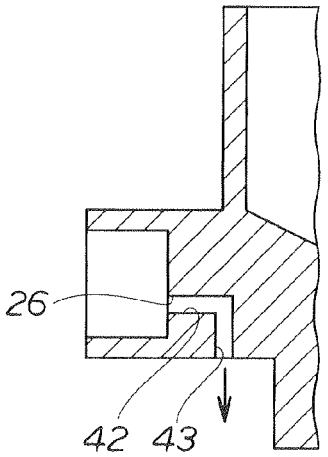

FIGS. 7A to 7C show a fuel channel in the present embodiment, and FIGS. 8A to 8C show a drain channel in the present embodiment.

The circular concavity 28 can be seen at the center when the fuel chamber 13 is viewed from above, as shown in FIG. 7A. The small-diameter concavity 32 is provided in a position that does not interfere with the circular concavity 28, as shown by the dashed line.

In the embodiment, the rotational axis 15 of the cock is disposed so as to be inclined at the angle of inclination θ1 in relation to the central axis 16 of the intake pipe.

The L-shaped pipe 27 and the hole 23 are connected by the first fuel channel 36, as shown in FIG. 7B.

The hole 24 and the junction chamber 30 are connected by the second fuel channel 37, as shown in FIG. 7C.

Fuel supplied from a fuel tank 55 (refer to FIG. 10) reaches the cock-accommodating concavity 22 via the L-shaped pipe 27 and the first fuel channel 36. The hole 23 and the hole 24 are in communication with each other, and fuel reaches the junction chamber 30 via the second fuel channel 37 when the cock 14 is rotated and the inclined surface 14*b* is positioned on the hole 23 and the hole 24, as shown in FIG. 3. Moreover, the fuel reaches the inside of the chamber 18 via the third fuel channel 38 that extends from the small-diameter concavity 32 in the junction chamber 30, as shown in FIG. 7C.

In addition, the first drain channel 41 is extended straight from the circular concavity 28 toward the cock-accommodating concavity 22 so as to pass through an area to the side of the small-diameter concavity 32, as shown in FIGS. 8A and 8B. The remaining fuel is discharged via the first drain channel 41, the second drain channel 42, and the third drain channel 43, as shown by the arrow in FIG. 8C.

Specifically, the fuel chamber 13 has the circular concavity 28 in the center in a planar view, and has the single small-diameter concavity 32 on the perimeter of the circular concavity 28 so as not to interfere with the circular concavity 28. The small-diameter concavity 32 is disposed so as to be substantially tangential (circumscribing) relative to a line 44 that passes through the center of the circular concavity 28 and is orthogonal to the central line 16 of the intake pipe.

In the example shown in FIG. 6A, a drain channel is provided by circumventing such a small-diameter concavity in an L shape. In contrast, the rotational axis 15 of the cock in the present embodiment is disposed so as to be inclined at the angle of inclination θ1 in relation to the central axis 16 of the intake pipe, and the first drain channel 41 can therefore by made into a rectilinear channel by passing the first drain channel 41 in the vicinity of a side surface of the small-diameter concavity 32 nearer the central axis 16 of the intake pipe.

The remaining fuel can be discharged smoothly because of the rectilinear channel, and the man-hours required for processing are also reduced.

An example in which a carburetor of such an aspect is mounted in a general purpose engine is described next.

Figure 9:
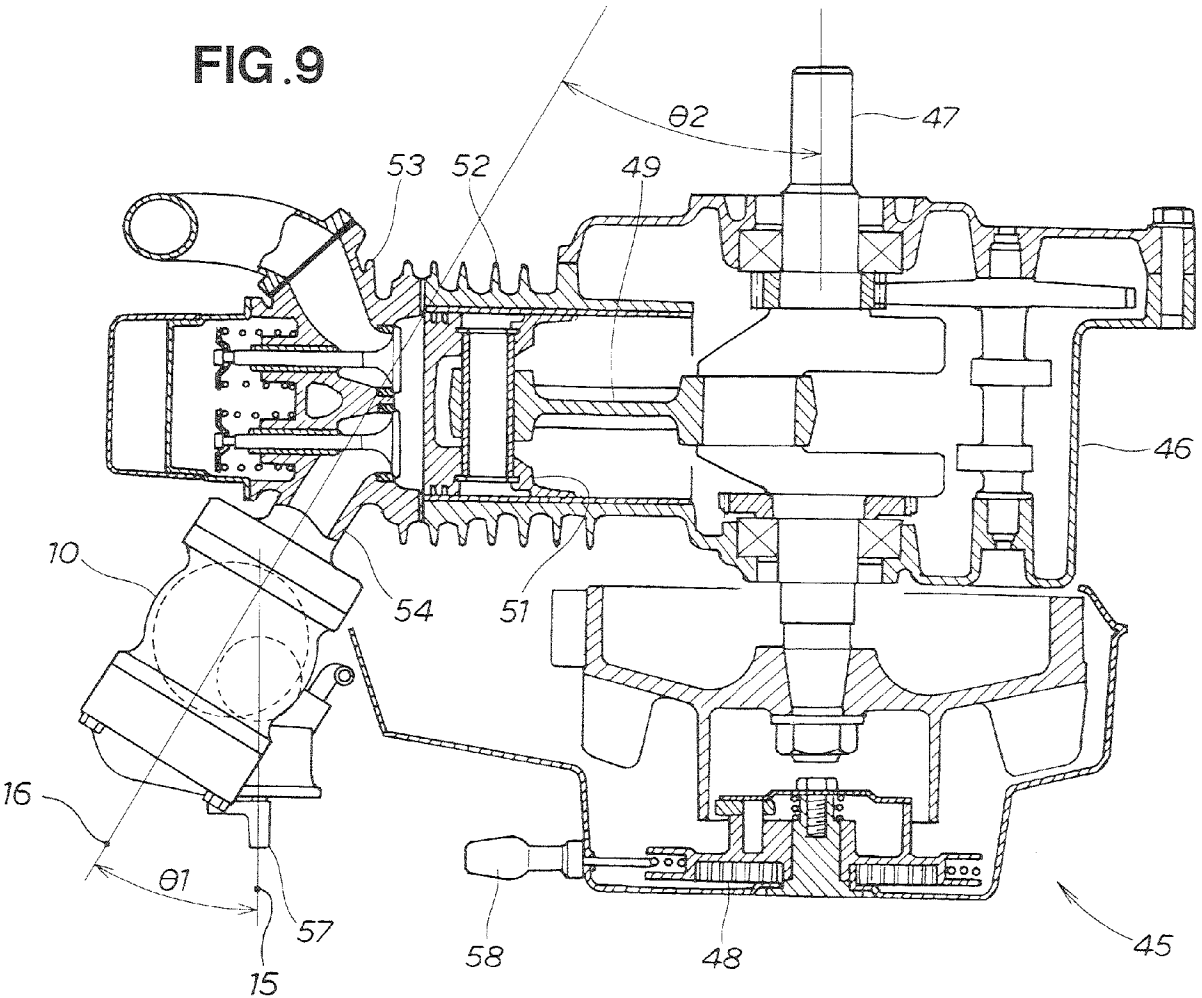
FIG. 9 is a cross-sectional view of the general purpose engine according to the embodiment of the present invention.

FIG. 9 shows a general purpose engine equipped with a carburetor according to the aforementioned embodiment.

Referring to FIG. 9, a general purpose engine 45 has a crankcase 46, a crankshaft 47 accommodated in the crankcase 46, a recoil starter 48 provided to an end of the crankshaft 47 and used at start-up, a connection rod 49 extending at a right angle from the crankshaft 47, a piston 51 linked to the connection rod 49, a cylinder 52 extending from the crankcase 46 and used for housing the piston 51, a cylinder head 53 for covering one end of the cylinder 52, and an intake pipe 54 extending from the cylinder head 53.

The intake pipe 54 extends obliquely toward one end of the crankshaft 47 at a given angle of inclination θ2 in relation to the crankshaft 47.

Assuming that the given angle of inclination θ2 and the angle of inclination θ1 are substantively the same, the rotational axis 15 of the cock in the carburetor 10 interposed in the intake pipe 54 extends toward one end of the crankshaft 47 so as to be parallel to the crankshaft 47.

Specifically, the cock 14 (FIG. 2B) is disposed at the front surface of the general purpose engine similar to the recoil starter 48.

Figure 10:
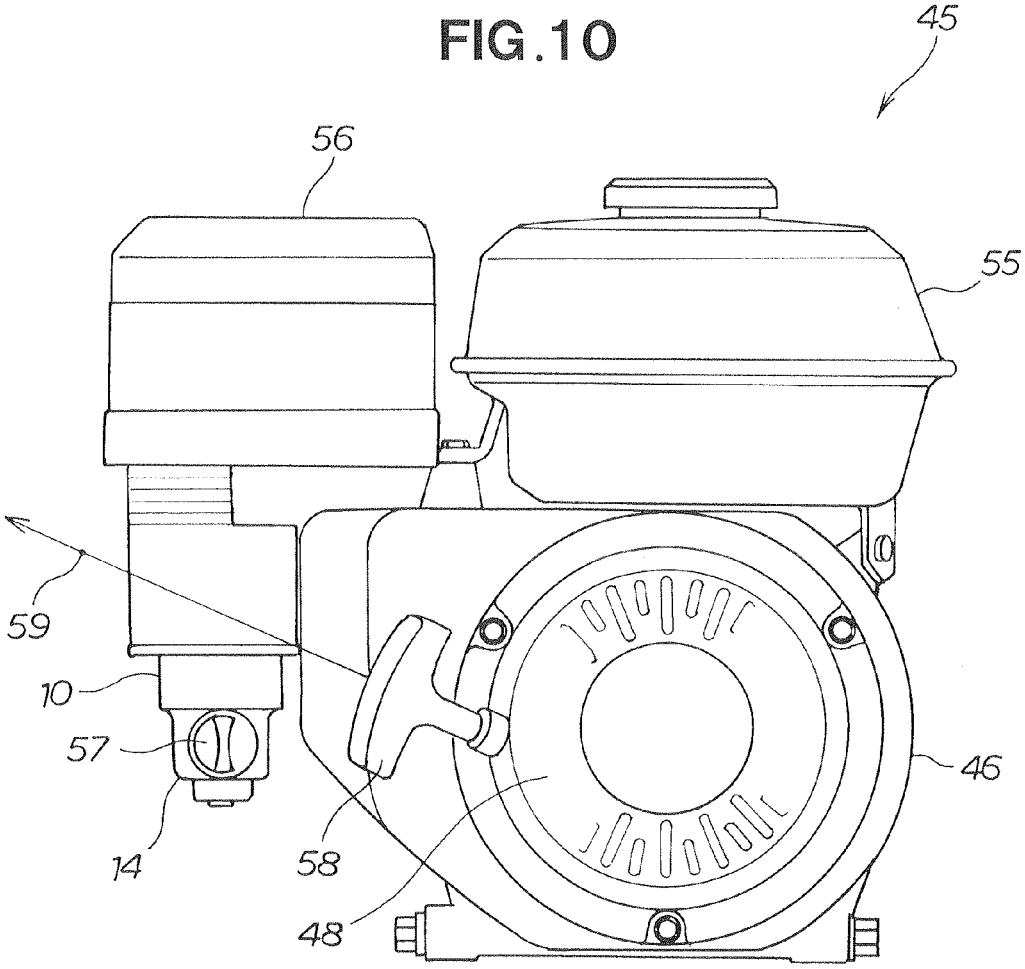
FIG. 10 is a front view of the general purpose engine according to the embodiment of the present invention.
Figure 11:
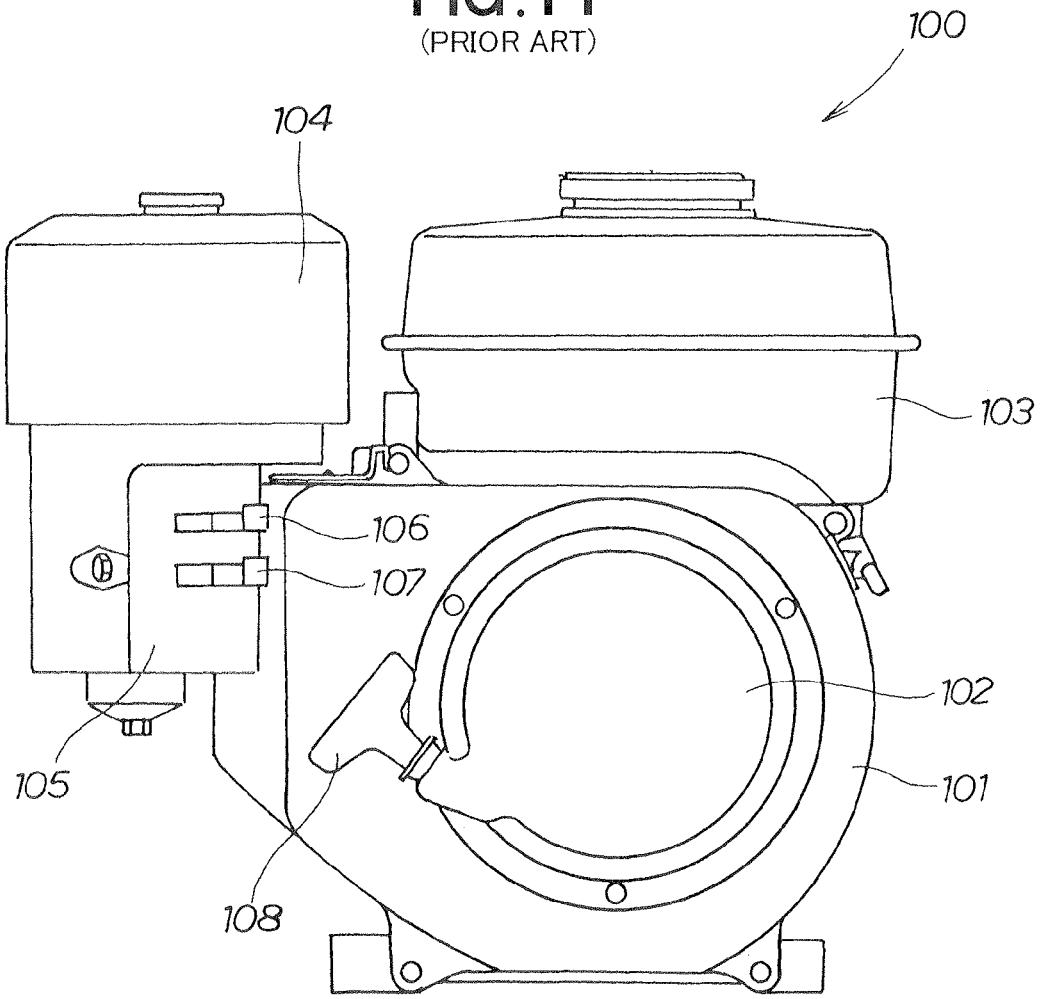
FIG. 11 (PRIOR ART)
FIG. 11 is a front view showing a conventional general purpose engine.

FIG. 10 is a front view of a general purpose engine. The general purpose engine 45 has the recoil starter 48 in front of, i.e., on the front surface of, the crankcase 46, has a fuel tank 55 above the crankcase 46, has an air cleaner 56 in an area to the side of the fuel tank 55, and has the carburetor 10 underneath the air cleaner 56.

The cock 14 is included in the lower part of the carburetor 10, and the operating lever 57 of the cock 14 is easy to operate because the operating lever 57 is positioned facing the front surface.

In addition, there is no concern that the cock 14 will interfere with the movement trajectory 59 of a starter grip 58 because the cock 14 is in a lower position.

The carburetor according to the present invention is preferably used in a general purpose engine, but may also be used in an automobile engine.

The carburetor according to the present invention is preferably used in a general purpose engine having a recoil starter.

Obviously, various minor changes and modifications of the present invention are possible in light of the above teaching. It is therefore to be understood that within the scope of the appended claims the invention may be practiced otherwise than as specifically described.

What is claimed is:

1. A carburetor having a fuel chamber and adapted to be disposed on an intake pipe such that fuel stored in the fuel chamber is siphoned and atomized by an airflow that flows through the intake pipe and mixed with the air, the carburetor comprising:

a carburetor body having a pair of connectors for connecting to the intake pipe, the fuel chamber being connected to a bottom surface of the carburetor body for storing the fuel;

fuel channels, provided to the fuel chamber, for guiding the fuel from a fuel tank to the fuel chamber;

drain channels, provided to the fuel chamber, for guiding drains from a bottom of the fuel chamber to outside; and a rotary cock, attached to the fuel chamber, for opening and closing the fuel channels and the drain channels, wherein the cock has a rotational axis inclined relative to a central axis of the intake pipe.

2. The carburetor of claim 1, wherein the drain channels extend in a straight line from the fuel chamber to the cock.

3. A general purpose engine comprising: a crankcase; a crankshaft accommodated in the crankcase; a recoil starter provided to one end of the crankshaft for use at start-up; a connecting rod extending at a right angle from the crankshaft; a piston linked to the connecting rod; a cylinder extending from the crankcase and accommodating the piston; a cylinder head for covering one end of the cylinder; an intake pipe extending from the cylinder head; and a fuel tank, wherein the intake pipe extends obliquely toward one end of the crankshaft at a given angle of inclination relative to the crankshaft, and the carburetor is provided to the intake pipe, and wherein the carburetor comprises:

a carburetor body having a pair of connectors for connecting to the intake pipe;

a fuel chamber, connected to a bottom surface of the carburetor body, for storing fuel;

fuel channels, provided to the fuel chamber, for guiding the fuel from a fuel tank to the fuel chamber;

drain channels, provided to the fuel chamber, for guiding drains from a bottom of the fuel chamber to outside; and a rotary cock, attached to the fuel chamber, for opening and closing the fuel channels and the drain channels, and wherein the cock has a rotational axis inclined relative to a central axis of the intake pipe and extending toward one end of the crankshaft so as to be parallel with the crankshaft.

4. The engine of claim 3, wherein the drain channels extend in a straight line from the fuel chamber to the cock.

* * * * *